US007124730B2

(12) United States Patent
Schwarzl et al.

(10) Patent No.: US 7,124,730 B2
(45) Date of Patent: Oct. 24, 2006

(54) OIL CATCHING SYSTEM FOR AN INTERNAL-COMBUSTION ENGINE, PARTICULARLY FOR AN OPPOSED-CYLINDER ENGINE

(75) Inventors: Christian Schwarzl, Kaindorf (AT); Tobias Baeumler, Leonberg (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 292 days.

(21) Appl. No.: 10/794,391

(22) Filed: Mar. 8, 2004

(65) Prior Publication Data

US 2004/0231924 A1 Nov. 25, 2004

(30) Foreign Application Priority Data

Mar. 8, 2003 (DE) ..... 103 10 179

(51) Int. Cl.
*F01M 1/00* (2006.01)

(52) U.S. Cl. ..... 123/196 R; 123/90.38; 123/196 S

(58) Field of Classification Search ..... 123/196 R, 123/90.38, 196 S, 196 CP; 184/6.23, 106
See application file for complete search history.

(56) References Cited

U.S. PATENT DOCUMENTS 5,579,729 A * 12/1996 Batzill et al. ..... 123/55.5
6,131,543 A 10/2000 Achenbach et al.
6,823,968 B1 * 11/2004 Baeumler ..... 184/106
2003/0042078 A1 * 3/2003 Baeumler ..... 184/6.23

FOREIGN PATENT DOCUMENTS

| | | |
|---|---|---|
| DE | 198 18 590 | 3/2000 |
| DE | 10139709 A1 | 2/2003 |
| EP | 0924396 A1 | 6/1998 |
| GB | 2278400 A | 11/1994 |
| GB | 2279109 A | 12/1994 |
| JP | 58200017 A | 11/1983 |

OTHER PUBLICATIONS

European Search Report mailed Jun. 28, 2004.

* cited by examiner

*Primary Examiner*—Tony M. Argenbright
*Assistant Examiner*—Katrina Harris
(74) *Attorney, Agent, or Firm*—Crowell & Moring LLP

(57) ABSTRACT

An oil catching system for an internal-combustion engine, particularly for an opposed cylinder engine, has an oil catching housing arranged below a crankcase. An oil suction space is provided in the oil catching housing from which the lubricating oil is transported by way of a main oil pump equipped with an oil suction pipe to consuming devices. At least one oil collecting space adjoins the oil suction space, in which oil collecting space the lubricating oil coming from the consuming devices is returned by way of an oil pipe. The oil suction space is separated from the oil collecting space by at least one oil separating wall, in which at least one passage opening is arranged which can be controlled by way of a flap, by way of which passage opening the lubricating oil can flow from the oil collecting space into the oil suction space.

16 Claims, 5 Drawing Sheets

OIL CATCHING SYSTEM FOR AN INTERNAL-COMBUSTION ENGINE, PARTICULARLY FOR AN OPPOSED-CYLINDER ENGINE

BACKGROUND AND SUMMARY OF THE INVENTION

This application claims the priority of German Application No. 103 10 179.9-13 filed Mar. 8, 2003, the disclosure of which is expressly incorporated by reference herein.

The invention relates to an oil catching system for an internal-combustion engine, particularly for an opposed-cylinder engine. Certain preferred embodiments of the invention relate to an oil catching system for an internal-combustion engine, particularly for an opposed-cylinder engine, having an oil catching housing arranged below a crankcase, in which oil catching housing an oil suction space is provided from which lubricating oil is transported to consuming devices by way of a main oil pump equipped with an oil suction pipe, and wherein at least one oil collecting space adjoins the oil suction space, in which oil collecting space the lubricating oil coming from the consuming devices is returned by way of an oil pipe, the oil suction space being separated from the oil collecting space by at least one oil separating wall in which at least one passage opening is arranged which can be controlled by way of a flap, by way of which passage opening the lubricating oil can flow from the oil collecting space into the oil suction space.

In the case of the current water-cooled 6-cylinder horizontally opposed engines of the 911 Carrera Series (Dr. Ing. h.c. F. Porsche Corporation), an oil separating case, which is fastened at the oil pan cover is provided in the oil bearing housing or in the oil pan, in which oil separating case the oil sump for the lubricating oil supply of the engine is constructed. The lubricating oil returned from the consuming devices into the oil pan is first guided back outside the oil separating case forming the oil suction space, before it flows by way of openings monitored by flaps in the oil separating case into the actual oil suction space.

It is an object of the invention to further improve the so-called integrated dry sump with respect to its functionality in order to reach a high degree of integration which simultaneously includes a reduction of the extent of the preassembly.

According to certain preferred embodiments of the invention, this object is achieved by providing an oil catching system for an internal-combustion engine, particularly for an opposed-cylinder engine, having an oil catching housing arranged below a crankcase, in which oil catching housing an oil suction space is provided from which lubricating oil is transported to consuming devices by way of a main oil pump equipped with an oil suction pipe, wherein at least one oil collecting space adjoins the oil suction space, in which oil collecting space the lubricating oil coming from the consuming devices is returned by way of an oil pipe, the oil suction space being separated from the oil collecting space by at least one oil separating wall in which at least one passage opening is arranged which can be controlled by way of a flap, by way of which passage opening the lubricating oil can flow from the oil collecting space into the oil suction space, and wherein a wall section is provided which bounds the oil collecting space and is spaced away from the oil separating wall, which wall section, relative to the passage opening in the oil separating wall, extends in a diagonally inclined manner and is used as a flow-off surface for the lubricating oil returned into the oil collecting space.

According to preferred embodiments of the invention, a bevel is provided which is shaped out of a wall section in the oil collection space and which is used as the flow-off surface for the lubricating oil returned into the oil collecting space. This obliquely extending side wall of the oil collecting space advantageously assists the oil return from the cylinder heads to the suction point. The lubricating oil, which is, for example, returned from the cylinder heads, flows onto the obliquely extending flow-off surface and from there by way of the openings provided in the oil separating wall into the oil suction space. Because of the construction of obliquely extending flow-off surfaces, the volume of the oil collecting space can be reduced while the functionality of the pressure lubrication is maintained. Simultaneously, as a result of the approach flow of the returning oil, which is directed in a defined manner, the flow-off surfaces are used for defoaming the lubricating oil. They therefore take over the function of the otherwise normally used oil/air separators, the so-called swirl pots.

Additional advantages and advantageous further developments of the invention are described herein and in the claims.

According to certain preferred embodiments of the invention, the wall section, which in the oil collecting space is equipped with the lubricating oil flow-off surface, is advantageously shaped in one piece out of an oil cover closing off the oil catching housing in the downward direction. In certain preferred embodiments the cover is made using plastic and in this case, the plastic part provided for the flow-off surface can be shaped out such that previous dead spaces existing in the oil sump can be considerably reduced. Thus, the internal-combustion engine can be operated by means of a lower lubricating-oil circulating quantity, whereby weight and cost advantages can be achieved.

According to certain preferred embodiments of the invention, the obliquely extending flow-off surfaces, which are simultaneously provided for the defoaming of the lubricating oil, may additionally be provided with ribs, naps or similar shaped bodies so that the lubricating oil is correspondingly deaerated on the way into the oil suction space.

According to certain preferred embodiments of the invention, the two oil separating walls bounding the oil suction space as well as oil return flow pipes arranged in the oil collecting space are combined in one piece as a sort of preassembly module. The integration of the components belonging to the dry sump is further increased if the oil suction snorkel arranged in the oil collecting space is combined with the two oil return flow pipes in one piece as a joint module.

Two embodiments of the invention will be explained in detail in the following description and drawing.

Other objects, advantages and novel features of the present invention will become apparent from the following detailed description of the invention when considered in conjunction with the accompanying drawings.

DETAILED DESCRIPTION OF THE DRAWINGS

Figure 2:
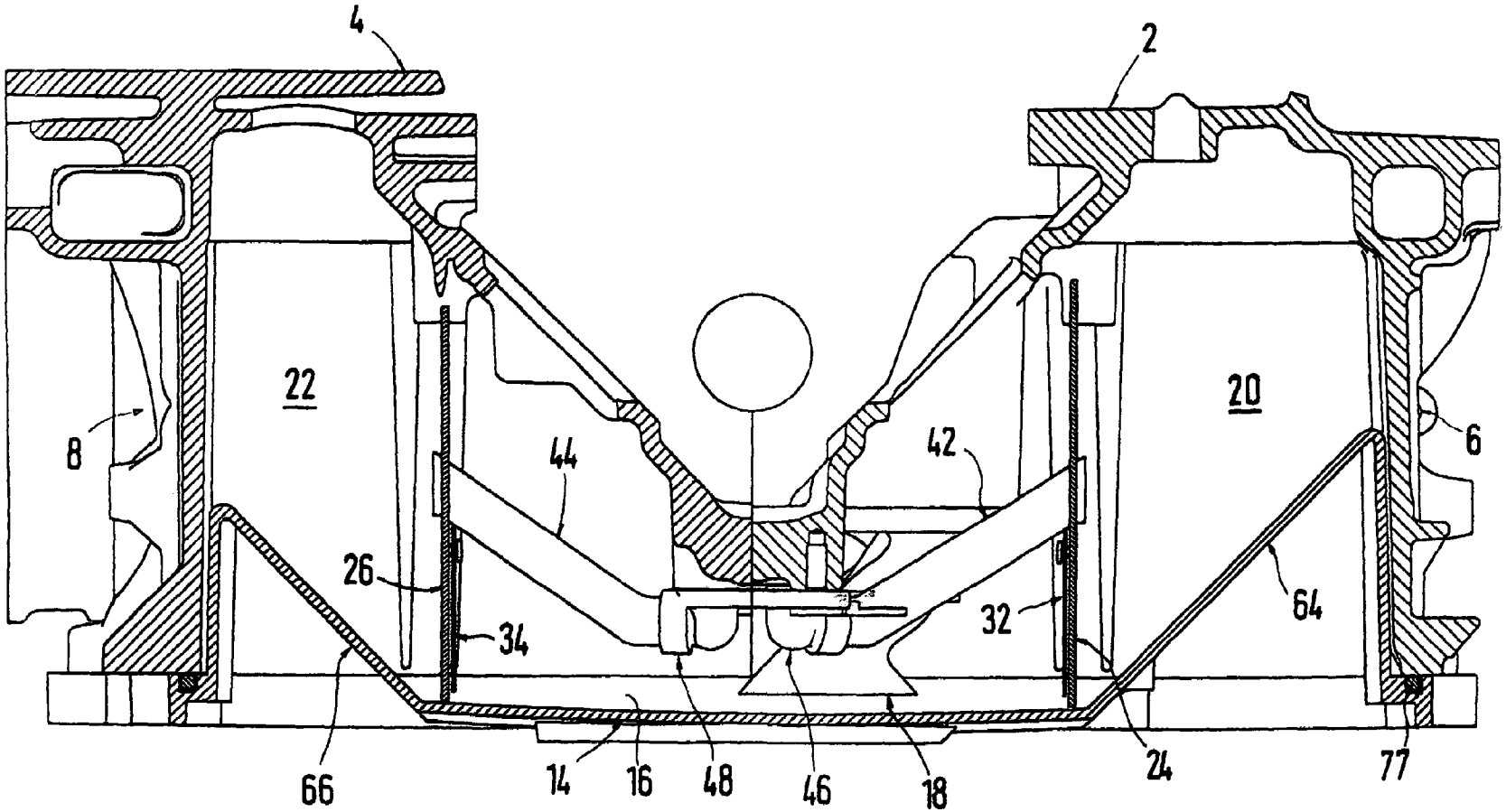
FIG. 2 is a cross-sectional view of the oil bearing housing and oil catching system.
Figure 3:
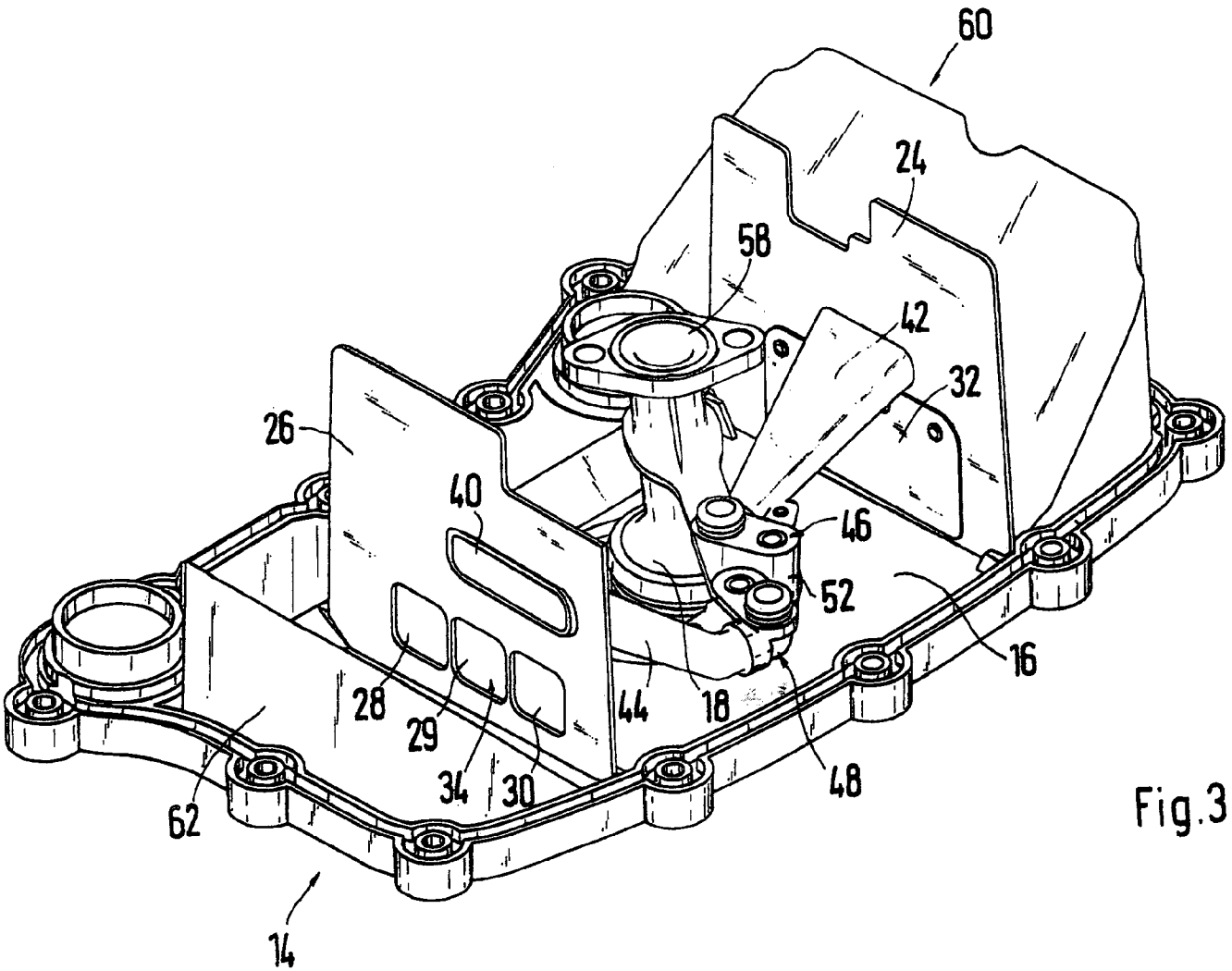
FIG. 3 is a perspective view of an oil cover with a separating space module of the preferred embodiment of the invention.

Without being limited to this embodiment, the crankcase of a 6-cylinder horizontally opposed engine illustrated as a sectional view in FIG. 2 comprises two crankcase halves 2 and 4 with two horizontally arranged cylinder bank rows 1 to 3 and 4 to 6 (not shown). A downward-extending wall section 6 and 8 is shaped out of each of the two crankcase halves 2 and 4, which wall sections 6 and 8, together with an oil cover 14 fastened to the flange surfaces 10 and 12 of the two wall sections 6 and 8, form an oil catching housing, in the following called oil pan. The oil pan has an oil suction space 16 in which an oil suction snorkel 18 is arranged which leads to a main oil pump which is not shown. On the left and the right of the oil suction space 16, two oil collecting spaces 20 and 22 are constructed which are separated from the oil suction space 16 by two oil separating walls 24 and 26. Both oil separating walls 24 and 26 are provided with three window-type passage openings 28, 29 and 30 respectively, which passage openings 28, 29 and 30 are controlled by one flow flap 32 and 34 respectively which operates as a return valve. For fastening the flow flaps 32 and 34 opening only into the oil suction space 16, four holding pins 36 respectively, which are fastened to the oil separating walls 24, 26, are provided for each flow flap 32, 34, on which holding pins 36 the flow flap 32, 34 is disposed. The elastically constructed flow flaps 32, 34 preferably consist of rubber.

Figure 4:
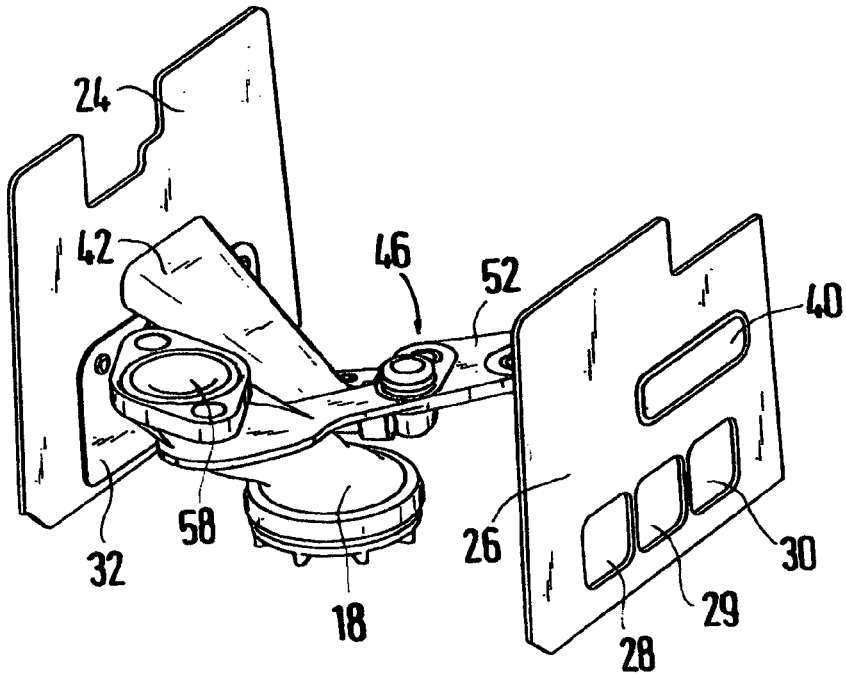
FIG. 4 is an individual representation of the separating space module of FIG. 3.

Above the three passage openings 28 to 30 arranged in the two oil separating walls 22 and 24, one additional rectangular opening 38 and 40 respectively is provided to which one oil return flow pipe 42 or 44 respectively extends which expands in a funnel-shaped manner. The respective other end of the two oil return flow pipes 42, 44 is in each case connected by way of a connection piece 46 and 48 to two return flow ducts 50 integrated in the crankcase halves 2 and 4. The two oil return flow ducts 50 formed by the crankcase halves 2 and 4 are separated by a separating wall which is not shown and which is arranged in the area between the two connection pieces 46 and 48. The two connection pieces 46, 48 are connected with one another by way of a connection plate 52; the latter is fastened to the crankcase 2, 4 by way of two screwed-connection points 54 and 56. At the same time, the oil suction snorkel 18 is connected in one piece to the connection plate 52, the connection flange 58 of the oil suction snorkel 18 being screwed to the crankcase 2. As illustrated in FIG. 4, the two oil separating walls 24, 26 as well as the two oil return flow pipes 42, 44, together with the oil suction snorkel 18, form a one-piece plastic separating space module, which is constructed as a prefabricated sub-assembly unit.

For laterally bounding the two oil collecting spaces, the oil cover 14, which also consists of a plastic material, has two ramps 60 and 62, which are connected in one piece with the oil cover 14 and which, in the mounted condition of the engine, engage in the two oil collecting spaces 20 and 22. The two ramps 60 and 62 each have one wall section 64 and 66 respectively which bounds the oil collecting space 20 or 22 and is provided with a bevel, which wall section 64 and 66 serves as an oil flow-off surface for the lubricating oil returned into the oil collecting space 20, as will be explained below in detail. Furthermore, two cylindrical sealing stubs 68 and 70 are shaped out of the oil cover 14 and, in the mounted condition, sealingly engage in openings 72 and 74 provided in the crankcase 2, 4. As a result two coolant ducts are sealed off which adjoin the oil sump of the crankcase. In addition, a drain screw for the coolant may be provided in one of these sealing devices. For the sealing-off with respect to the flange surfaces 10, 12, the oil cover 14 consisting of plastic has a surrounding groove-shaped contour 76 into which an elastomer seal 77 is inserted. In addition, for screwing the oil cover 14 to the crankcase 2, 4, corresponding flange screwing connection points 78 are shaped out of the outer contour of the oil cover 14. The oil suction snorkel 18 engages in a can-shaped recess 80 provided in the oil cover 14.

Figure 1:
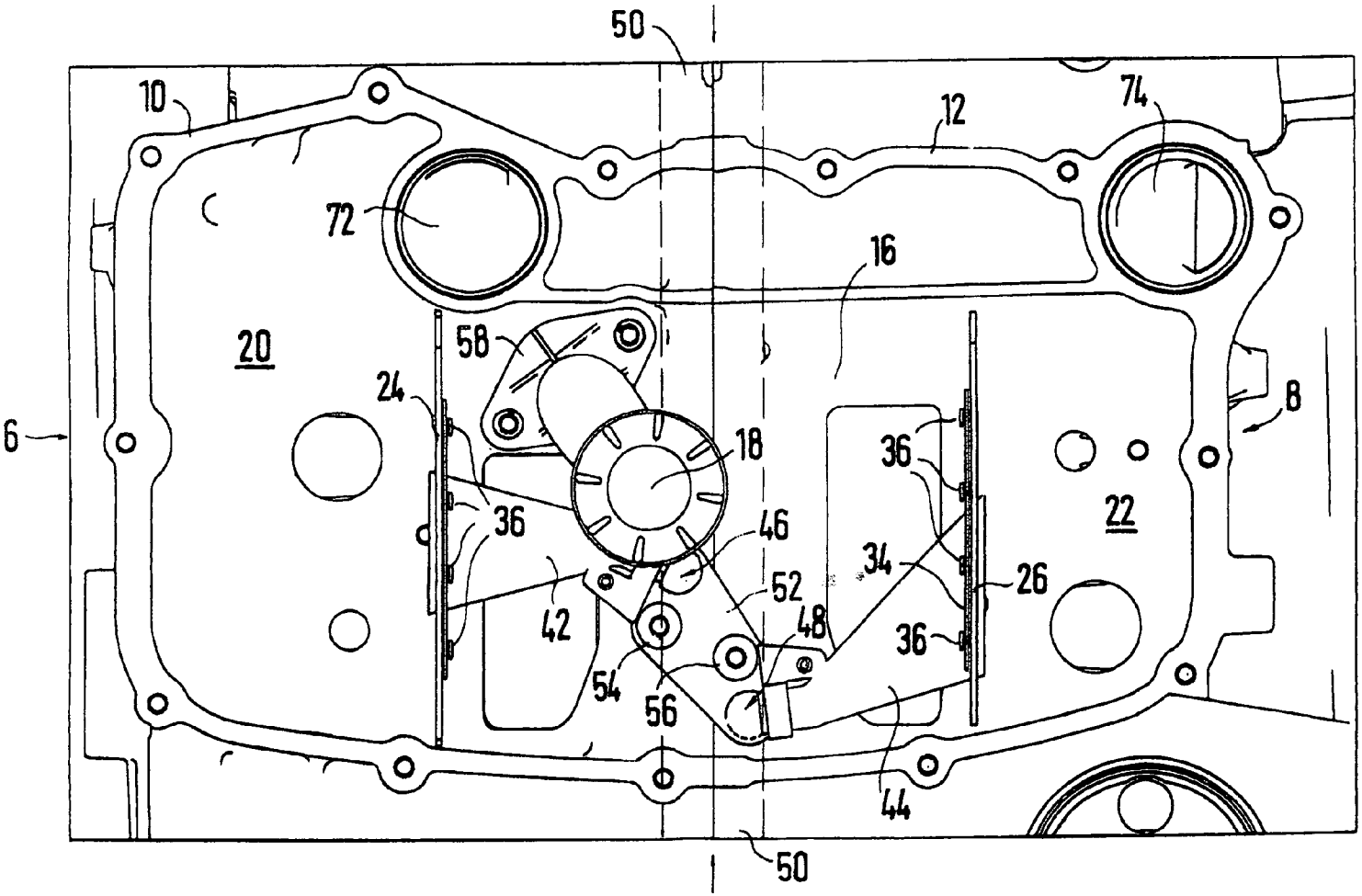
FIG. 1 is a view of the oil bearing housing from below, of an oil catching system constructed according to a preferred embodiment of the invention.

The oil return into the oil pan takes place in the following manner:

The lubricating oil removed by suction from the two cylinder heads of the engine is returned into the two oil collecting spaces 20 and 22 by way of the two oil return flow ducts 50 (oil return flow indicated by means of the arrows in FIG. 1) and by way of the two oil return flow pipes 42 and 44. When the lubricating oil flows out into the oil collecting spaces 20, 22, the lubricating oil flows onto the two obliquely extending wall sections 64, 66 of the two ramps 60, 62 arranged in the oil collecting space 20, 22; then flows off on these ramps 60, 62 and, as a function of the height of the oil level, flows by way of the openings 28 to 30 controlled by the flaps 32, 34 into the oil suction space 16. From there, it is fed in a known manner back to the consuming devices by way of the main oil pump which is not shown. When the lubricating oil flows off on the wall sections 64, 66, it is defoamed and the gaseous constituents can thereby be separated from the lubricating oil. The defoaming of the returning lubricating oil can be further improved if the flow-off surfaces 64, 66 are additionally provided with ribs, nabs or similar shaped bodies.

Figure 5:
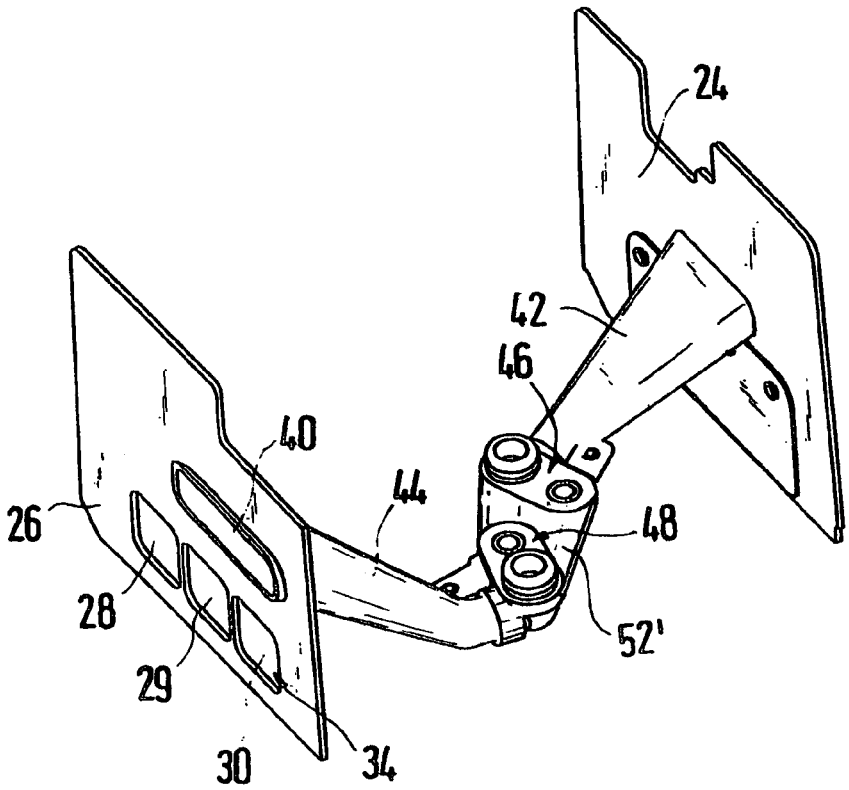
FIG. 5 is a view of the separating space module according to a second embodiment.
Figure 6:
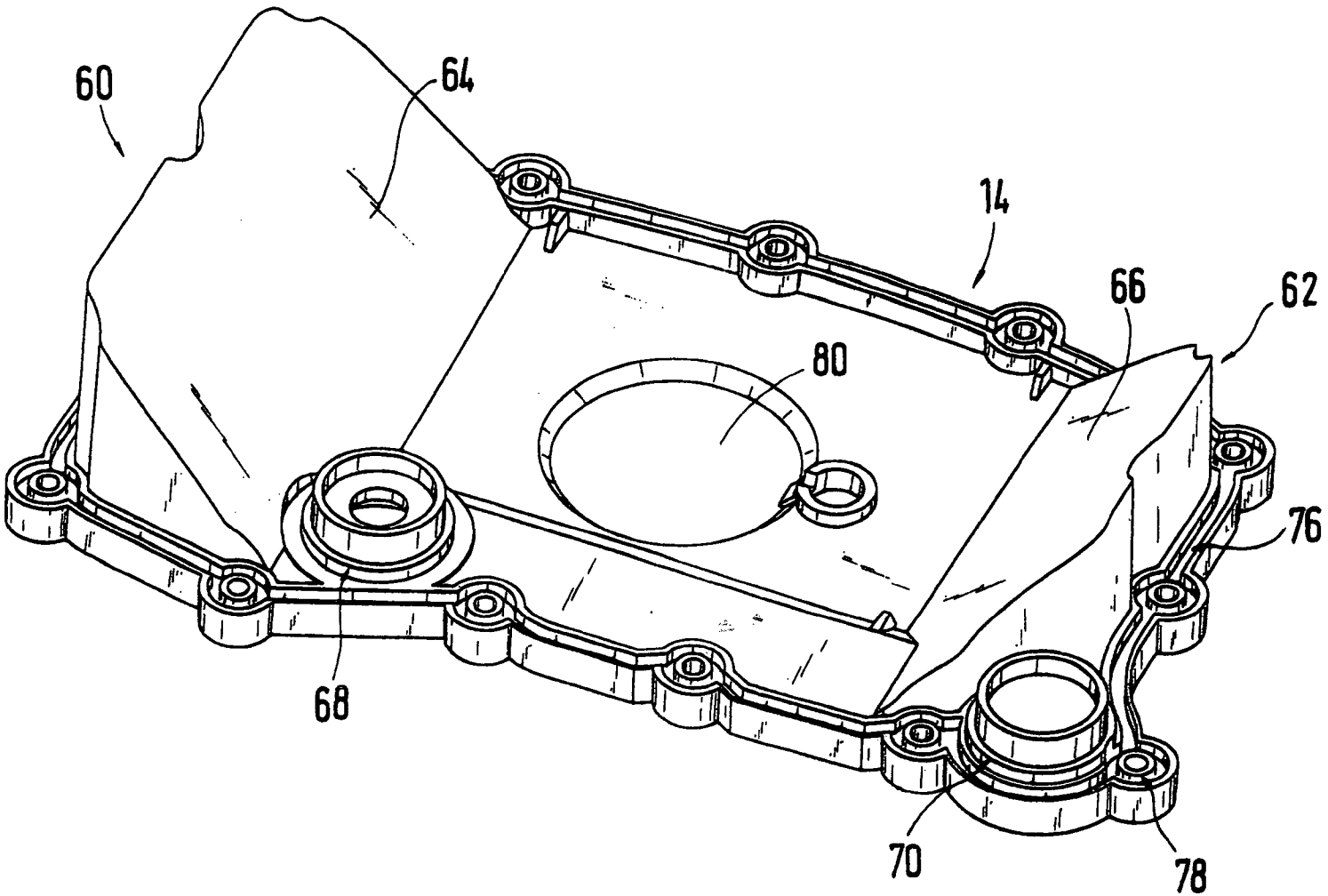
FIG. 6 is a perspective view of the oil cover of the catching system showing the flow-off surfaces for the lubricating oil.

FIG. 5 shows a second embodiment which is only slightly modified compared to the first embodiment and, with respect to the method of operation, is identical to that of the first embodiment. In contrast to the first embodiment, the oil suction snorkel 18 is not fastened in one piece to the separating space module, but is arranged to be extending separately therefrom.

What is claimed is:

1. Oil catching system for an internal-combustion engine, particularly for an opposed-cylinder engine, having an oil catching housing arranged below a crankcase, in which oil catching housing an oil suction space is provided from which lubricating oil is transported to consuming devices by way of a main oil pump equipped with an oil suction pipe to consuming devices, wherein at least one oil collecting space adjoins the oil suction space, in which oil collecting space the lubricating oil coming from the consuming devices is returned by way of an oil pipe, the oil suction space being separated from the oil collecting space by at least one oil separating wall in which at least one passage opening is arranged which can be controlled by way of a flap, by way of which passage opening the lubricating oil can flow from the oil collecting space into the oil suction space, and wherein a wall section is provided which bounds the oil collecting space and is spaced away from the oil separating wall, which wall section, relative to the passage opening in the oil separating wall, extends in a diagonally inclined manner and is used as a flow-off surface for the lubricating oil returned into the oil collecting space, and two oil return flow pipes are arranged in the oil collecting space, which oil return flow pipes are connected on one side with oil return flow ducts integrated in the crankcase and, on the other side, in each case, lead into at least one opening provided in the oil separating wall.

2. Oil catching system according to claim 1, wherein the wall section is part of a ramp which is constructed in one piece with an oil cover closing off the oil catching housing in the downward direction.

3. Oil catching system according to claim 2, wherein the oil cover and the ramp consist of a plastic material.

4. Oil catching system according to claim 3, wherein, on the left and the right of the oil suction space, a respective oil collecting space is provided which is separated from the oil suction space by a respective oil separating wall.

5. Oil catching system according to claim 2, wherein, on the left and the right of the oil suction space, a respective oil collecting space is provided which is separated from the oil suction space by a respective oil separating wall.

6. Oil catching system according to claim 1, wherein, on the left and the right of the oil suction space, a respective oil collecting space is provided which is separated from the oil suction space by a respective oil separating wall.

7. Oil catching system according to claim 1, wherein the two oil separating walls as well as the two oil return flow pipes are combined to form a separating space module.

8. Oil catching system according to claim 7, wherein an oil suction snorkel is combined with the two oil return flow pipes.

9. Oil catching system according to claim 1, wherein the two oil separating walls as well as the two oil return flow pipes are combined to form a separating space module.

10. Oil catching system according to claim 9, wherein an oil suction snorkel is combined with the two oil return flow pipes.

11. Lubricating oil catching system for an internal combustion engine, comprising:

a lubricating oil catching housing with a lubricating oil suction space from which oil is transported to oil consuming devices, an oil collecting space adjoining the oil suction space, an oil separating wall separating the oil suction space and oil collection space, sail oil separating wall including at least one passage opening for oil flow from the oil collecting space to the oil suction space, and a wall section bounding a portion of the oil collecting space at a position spaced from the oil separating wall, said wall section being inclined with respect to the at least one passage opening and serving as a flow off surface for oil returned to the oil collection space, wherein two oil return flow pipes are arranged in the oil collecting space, which oil return flow pipes are connected on one side with oil return flow ducts integrated in the crankcase and, on the other side, in each case, lead into at least one opening provided in the respective oil separating wall.

12. System according to claim 11, wherein the wall section is part of a ramp which is constructed in one piece with an oil cover closing off the oil catching housing in the downward direction.

13. System according to claim 12, wherein the oil cover and the ramp consist of a plastic material.

14. System according to claim 11, wherein, on the left and the right of the oil suction space, a respective oil collecting space is provided which is separated from the oil suction space by a respective oil separating wall.

15. System according to claim 11, wherein the two oil separating walls as well as the two oil return flow pipes are combined to form a separating space module.

16. System according to claim 15, wherein an oil suction snorkel is combined with the two oil return flow pipes.

* * * * *